US011490740B2

(12) United States Patent
Papegaaij et al.

(10) Patent No.: US 11,490,740 B2
(45) Date of Patent: Nov. 8, 2022

(54) METHOD OF MONITORING THE QUALITY OF A MATTRESS

(71) Applicant: COVESTRO (NETHERLANDS B.V., Nieuwegein (NL)

(72) Inventors: Alwin Papegaaij, Echt (NL); Geert Doorlag, Deventer (NL); Hendrik Willem Dijkman, Deventer (NL); Jan Henderikus Udding, Echt (NL)

(73) Assignee: COVESTRO (NETHERLANDS) B.V., Geleen (NL)

( * ) Notice: Subject to any disclaimer, the term of this patent is extended or adjusted under 35 U.S.C. 154(b) by 0 days.

(21) Appl. No.: 17/264,086

(22) PCT Filed: Jul. 29, 2019

(86) PCT No.: PCT/EP2019/070383
§ 371 (c)(1),
(2) Date: Jan. 28, 2021

(87) PCT Pub. No.: WO2020/025551
PCT Pub. Date: Feb. 6, 2020

(65) Prior Publication Data

US 2021/0368999 A1 Dec. 2, 2021

(30) Foreign Application Priority Data

Jul. 31, 2018 (EP) ..... 18186579

(51) Int. Cl.
*A47C 31/12* (2006.01)
*A47C 27/06* (2006.01)

(52) U.S. Cl.
CPC ..... *A47C 31/123* (2013.01); *A47C 27/064* (2013.01)

(58) Field of Classification Search
CPC ..... A47C 31/00; A47C 31/12; A47C 31/123; A47C 27/06; A47C 27/064
See application file for complete search history.

(56) References Cited

U.S. PATENT DOCUMENTS 7,981,532 B2 * 7/2011 Mori ..... C01G 45/1264 252/182.1
2004/0128773 A1 7/2004 Barber
(Continued)

FOREIGN PATENT DOCUMENTS

AU 2007100311 5/2007
CN 104130737 11/2015
(Continued)

OTHER PUBLICATIONS

International Search Report for PCT/EP2019/070383, dated Sep. 3, 2019, 4 pages.
(Continued)

*Primary Examiner* — Fredrick C Conley
(74) *Attorney, Agent, or Firm* — Nixon & Vanderhye P.C.

(57) ABSTRACT

The invention pertains to a method of monitoring the quality of a mattress during its lifetime, wherein the mattress is an assembly of multiple separate parts, wherein the parts are mechanically interconnected, the method comprising during its lifetime, assessing at least one property of the mattress, determining whether or not the property meets a predetermined specification, and when the property does not meet the predetermined specification, identifying a part of the said multiple separate parts that corresponds to the property, removing the identified part from the assembly and optionally replacing the removed part with a replacement part, wherein the mattress that is monitored is manufactured by forming the mechanical interconnection with an adhesive, which adhesive has a first order phase-transition temperature between 80° C. and 180° C., at which temperature the
(Continued)

adhesive undergoes a solid-liquid transition, and wherein before the said removing of the identified part, the adhesive with which this part is interconnected with other parts in the assembly is heated to a temperature above its phase-transition temperature, whereafter the identified part is grasped and pulled out of the assembly. The invention also pertains to a method of manufacturing a mattress suitable for use in this monitoring method.

20 Claims, 3 Drawing Sheets

(56) References Cited

U.S. PATENT DOCUMENTS

2004/0139552 A1* 7/2004 Walters, Jr. ..... A47C 31/105 5/737
2010/0192299 A1* 8/2010 Schermel ..... A47C 27/085 5/717
2015/0164238 A1* 6/2015 Benson ..... A61B 5/6892 340/540

FOREIGN PATENT DOCUMENTS

| | | |
|---|---|---|
| CN | 205903087 | 1/2017 |
| CN | 107467971 | 12/2017 |
| DE | 295 01 779 | 7/1995 |
| GB | 1322963 | 7/1973 |
| GB | 2517813 | 3/2015 |

OTHER PUBLICATIONS

Written Opinion of the ISA for PCT/EP2019/070383, dated Sep. 3, 2019, 6 pages.
SABA adhesives & sealants" SABA Hotmelt Adhesive—Automatic Application (KSM) (EN)", YouTube, Jul. 3, 2013, XP054978791, retrieved Oct. 17, 2018.

* cited by examiner

METHOD OF MONITORING THE QUALITY OF A MATTRESS

CROSS-REFERENCE TO RELATED APPLICATIONS

This application is the U.S. national phase of International Application No. PCT/EP2019/070383 filed 29 Jul. 2019, which designated the U.S. and claims priority to EP Patent Application No. 18186579.1 filed 31 Jul. 2018, the entire contents of each of which are hereby incorporated by reference.

FIELD OF THE INVENTION

The invention pertains to the monitoring of the quality of a mattress and hence, indirectly to the quality of sleeping. The quality of sleeping, in particular the assessment of the presence, respiration and heart rate of a person (intended to be) sleeping on the mattress has been the subject of extensive research and hassled to the development of sleep monitoring products over the last decades.

BACKGROUND OF THE INVENTION

Sleep plays a vital role in good health and well-being throughout life of any person. Getting enough quality sleep at the right times can help protect the mental health, physical health, quality of life, and safety of a person. It has been known for a long time that during sleep, the body is working to support healthy brain function and maintain physical health. The damage from sleep deficiency can occur in an instant (such as a car crash), or it can harm over time. For example, ongoing sleep deficiency can raise the risk for some chronic health problems. It also can affect how well one thinks, reacts, works, learns, and gets along with others.

In the art obviously a lot of attention is given to the duration of sleep and also, the art has developed various technologies to monitor sleep quality by using various sensors, such as sensors that can determine e.g. presence, respiration and heart rate (see e.g. WO 2017/185809 and U.S. Pat. No. 8,583,206). Regarding the mattress itself, commonly a life-span of about 10 years is accepted as being an end-of-life point, or it is generally advised when starting to feel uncomfortable in the bed or start waking up with back pain, neck pain, stiffness etc. to consider a replacement, even when there is no proof of a relationship between the quality of the mattress and the sleeping problems. This may result in the unnecessary discarding of mattresses and hence, an unnecessary waste stream. Because mattresses are expensive to recycle, most mattresses are simply burned and remaining metal is used as scrap for the metal industry.

OBJECT OF THE INVENTION

It is an object of the invention to maintain the quality of a mattress while at the same time to reduce the stream of mattresses being offered for recycling by burning.

SUMMARY OF THE INVENTION

In order to meet the object of the invention, a method of monitoring a quality of a mattress during its lifetime is devised, wherein the mattress is an assembly of multiple separate parts, wherein the parts are mechanically interconnected, the method comprising during its lifetime, assessing at least one property of the mattress (e.g. local elasticity, integrity, local deformation, contamination etc.), determining whether or not the property meets a predetermined specification (which may be a particular value for the property as such, but may also be a specification that is derived therefrom), and when the property does not meet the predetermined specification, identifying a part of the said multiple separate parts that corresponds to the property, removing the identified part from the assembly and optionally replacing the removed part with a replacement part, wherein the mattress that is monitored is manufactured by forming the mechanical interconnection with an adhesive, which adhesive has a first order phase-transition temperature between 80° C. and 180° C. (and may thus have any intervening temperature of 81, 82, 83, 84 . . . 176, 177, 178 and 179° C.; all individual natural numbers between 80 and 180° have been disclosed herewith) at which temperature the adhesive undergoes a solid-liquid transition, and wherein before the said removing of the identified part, the adhesive with which this part is interconnected with other parts in the assembly is heated to a temperature above its phase-transition temperature, whereafter the identified part is grasped and pulled out of the assembly.

This invention is a concept as a whole and enables to continuously re-use as much parts of a mattress as possible and wherein it is only needed to discard those parts that are worn and determine the practical end of lifetime of the mattress. The inventors recognized that often, the practical end of life of a mattress is determined by only one property of a mattress, for example loss of support by one or more broken springs, or a loss of lying comfort by a partly compressed comfort layer etc. By assembling the mattress such the mechanical interconnections between the various parts (which connection may be directly between parts, or by applying intermediate material/parts/layers/sheeting etc.) are brought about by using an adhesive that undergoes a first order solid-to liquid transition above 80° C., the parts can be easily (and thus in an economical viable way) de-connected by simply heating the adhesive to above its phase-transition temperature: when turning into a liquid, the adhesive property of the adhesive gets lost to at least a substantial degree. And thus this way parts that are worn, or for any other reason bring about that the mattress does no longer meet a predetermined specification, can be easily removed and optionally replaced by a new part. This way, not only can the quality of the mattress be reassured for a longer period of time, but also, the amount of mattresses ending up as fuel or landfill can be decreased significantly. Instead of replacing the part that is identified to correspond to the failure to meet a predetermined specification, it is foreseen that if one particular part fails to meet the specification, that the part is not replaced, but that the mattress is disassembled completely, for example such that all or most of the parts can be used in new mattresses or other items. In either situation, the mattress as such is not discarded as waste to be burned or buried in the ground as landfill.

The invention was based on several recognitions by the inventors. Firstly, the inventors recognized that mattresses are usually not monitored for quality but simply discarded at some point in time, for example when reaching a certain age. This may simply be too early (since the mattress is still okay for its intended use) or too late (since the mattress already at an earlier stage failed to meet a reasonable quality standard). By monitoring the quality of the mattress itself, a better assessment of the actual end of lifetime of the mattress (i.e. the point in time where the mattress needs to be refurbished or recycled completely) can be determined. Also, the inventors recognized that failure to meet a predetermined property is often not the result of all parts being worn out evenly, but in many cases only the result of one or more parts that are either worn, or do no longer meet the demands (which might for example also change over time, e.g. when a person that uses the mattress gains weight). So, the ability to be able and easily remove individual parts is essential. Next to this, the inventors recognized that the use of an adhesive which has a first order phase-transition temperature between 80° C. and 180° C., at which temperature the adhesive undergoes a solid-liquid transition, is very advantageous in the present concept: the mechanical interconnection provided by such adhesives can be very high, but as soon as the temperature is increased to above the phase transition temperature where the adhesive turns into a liquid, the mechanical interconnection is almost instantly gone (or at least diminished substantially). This offers the ability to simply de-connect individual pars by heating the corresponding adhesive. This process is significantly easier than mechanically removing connective materials such as nails, clamps and wires, or exactly cutting through connective materials such as layers of adhesive, welds or stitches. It was only after all of these insights that the inventors were able to devise the method of the present invention. Moreover, by opting for a phase-transition temperature between 80° C. and 180° C., it is possible to choose an adhesive that allows to combine a good strength for a mattress during normal use (i.e. below 60° C.) and a de-connection of the various parts at a temperature where thermal deterioration of the parts can be prevented (i.e. well below 200° C.).

Adhesives that undergo a first order phase-transition belong to the class of so-called hot melt adhesives, i.e. adhesives that do not contain solvent and need to be heated to reduce their viscosity such that they can be applied. Hot melt adhesives are known for providing mechanical interconnection of parts in mattresses (see for example U.S. Pat. No. 4,578,834, GB 2211087 and WO 02/44076). However, typically the used adhesives are classified as hot melt adhesives simply because they do not contain any solvent. This however does not mean that they undergo a first order solid to liquid transition upon heating, let alone that this takes place at a temperature between 80° C. and 180° C. Polyamide hot melts for example are typically applied above 200° C. Next to this, the emphasis in the known use of hot melt adhesive in assembling mattresses is on the strength of the ultimate connection. The art has not taught that one should specifically choose an adhesive that allows easy de-connection, let alone to choose an adhesive that undergoes a solid-to liquid transition upon heating to a temperature above its phase transition temperature, and wherein that temperature should lie between 80° C. and 180° C., to enable the present invention.

The invention also pertains to a method of manufacturing a mattress suitable for use in a method as described here above, wherein the method comprises providing a first layer of contiguous pocketed springs, wherein the pockets are interconnected by adhering the pockets together using an adhesive, which adhesive has a first order phase-transition temperature between 80° C. and 180° C., at which temperature the adhesive undergoes a solid-liquid transition, and connecting an overlaying upholstery layer to the first layer by adhering the upholstery layer to the first layer using the said adhesive or another adhesive that has a first order phase-transition temperature between 80° C. and 180° C., at which temperature the adhesive undergoes a solid-liquid transition. The inventors recognised that the use of the specific adhesive is advantageously in particular for the use in assembling so-called pocketed spring mattresses. Although it was expected that the particular brittle adhesives of the presently claimed type (such adhesive upon cooling forms crystals) would not be suitable for creating in a thin layer a durable connection between parts that can deform significantly with respect to each other (such as neighbouring springs, or springs overlaid by a comfort layer), the opposite appeared to be true.

Definitions

Monitoring means to observe and check the quality of something over a period of time.

A mattress is a fabric case filled with resilient material (such as for example cotton, hair, feathers, foam rubber, or an arrangement of springs) used either alone as a bed or on a bedstead to support a person sleeping thereon.

The support layer of a mattress is the basic layer of the mattress and supports the sleeper's body. Modern spring mattress cores, often called "innersprings," are made up of steel coil springs, or "coils." In foam mattresses, a rectangular piece of thick foam is used as a support.

The lifetime of an object is the time between an object's manufacturing for a particular purpose and the point in time where its intended use ends, for example when it is destructed or used for another purpose.

To identify means to specify or designate as the object of interest.

A part corresponding to a property means that there is a relationship between the presence of the part and the measured property.

A first-order phase transition temperature of a material is the temperature at which the material undergoes a discontinuous change in density. Examples of first order transitions are melting (solid to liquid conversion) and evaporating (liquid to gas conversion). A glass-transition is a second order transition since there is no discontinuous change in density.

A pocketed spring is a spring which is typically individually wrapped in fabric encasement and which may thus deform rather independently from a neighbouring spring in another encasement. Pocketed springs are also called wrapped coils, encased coils, encased springs, or Marshall coils.

An upholstery layer of a mattress covers the support layer of the mattress and provides cushioning and comfort. It typically comprises two main parts, the insulator (to separate the upholstery from the support layer) and a layer of padding (providing comfort).

A three-dimensional reticulated material is a material that consists of a network of strings of solid material in a continuum of gas (air), as opposed to foam which is a dispersion of gas bubbles in a continuum of solid material (which continuum of solid material in case of a mattress is usually latex rubber, polyether or polyurethane).

A polyester polymer is a polymer that contains the ester functional group in its main chain. Polyester polymers are commonly used for producing threads or yarns to manufacture fabrics, but polyesters can also be used to make other objects such as bottles, film, finishing materials etc. Typical examples of polyester polymers are polyethylene terephthalate (PET), polybutylene terephthalate (PBT), polyethylene naphthalate (PEN), Vectran, polylactic acid (PLA), polycaprolactone (PCL), polyethylene adipate (PEA) and poly (3-hydroxybutyrate-co-3-hydroxyvalerate) (PHBV).

BRIEF DESCRIPTION OF DRAWING FIGURES

EMBODIMENTS OF THE INVENTION

Figure 1:
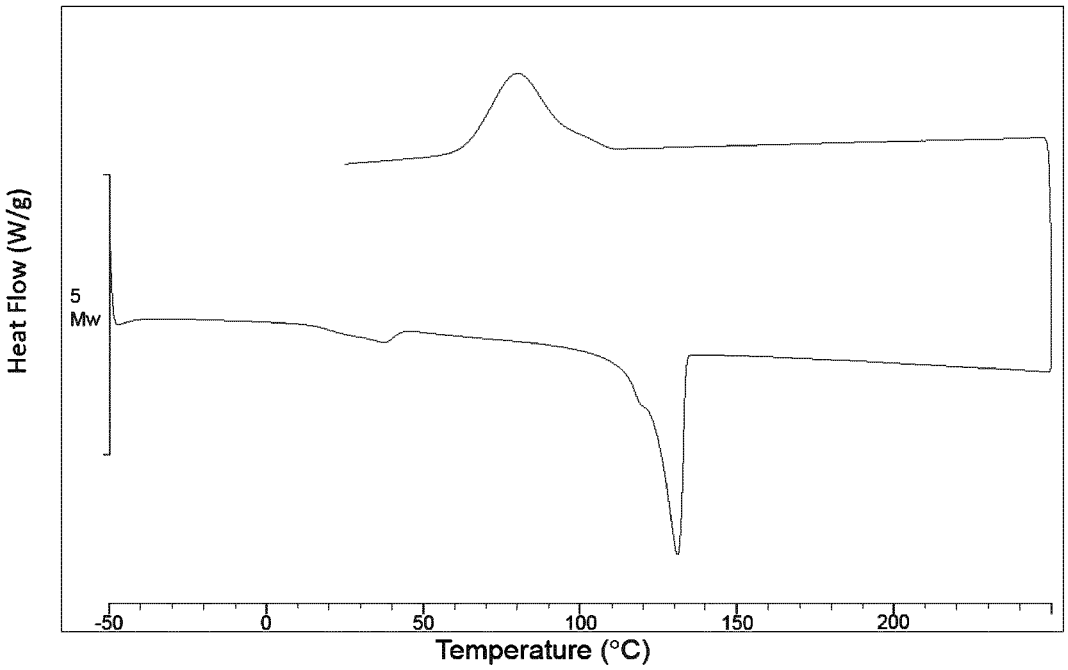
FIG. 1 is a DSC curve of an adhesive for use in the present invention.

In a first embodiment of the invention the assembly comprises a first layer having length and width dimensions that correspond to length and width dimensions of the mattress (i.e. having dimensions in the same range, i.e. less than ten times smaller or less than ten times larger, particularly maximally 5 times smaller or larger, more particularly 1-2 times smaller or larger, or even having the same dimensions), wherein the first layer is a support layer comprising a collection of contiguous pocketed springs, and each pair of two contiguous pocketed springs are mechanically interconnected by the adhesive. Although the nature of the adhesive for use in the present invention is intrinsically brittle, it was found that it can still be used to durably connect neighbouring springs by gluing their respective pockets together. Even a thin layer of the brittle adhesive is able to durably connect these (textile) pockets. This is not straightforward since the springs can individually be compressed, causing high tearing loads between the pockets.

In a second embodiment of the invention the assembly comprises two stacked layers having length and width dimensions that correspond to length and width dimensions of the mattress, wherein the layers have a different composition and different rigidity and wherein the two stacked layers are mechanically interconnected by an intermediate layer of the adhesive. Many mattresses consist essentially of a rectangular piece of foam (which may comprise different layers of a varying foam type), provided with a ticking. The foam layer(s) provide the support as well as the comfort. Another concept is to use two stacked layers of very different composition and rigidity, one layer to provide the needed support, the other layer to provide the comfort. A downside of the latter constitution is that these two different materials of different composition and different rigidity, deform completely differently when the mattress is in use and still, have to be mechanically interconnected to provide for a durable mattress. To achieve this, it was beforehand expected that the particular brittle adhesives of the presently claimed type would not be suitable for creating the durable connection. Surprisingly however, these adhesives appeared to be suitable, even in this arrangement of layers.

In a further embodiment the first layer of the two stacked layers is a support layer comprising a collection of contiguous pocketed springs. The second layer of the two stacked layers may be an upholstery layer. Even in such a case, where the deformation between the two layers is markedly different (not only because of the two very different compositions, but also of the presence of separate springs), the adhesives as used in the present invention may provide for a strong durable bond between neighbouring pockets and the upholstery layer, and at the same time allow for easy de-connection of individual parts. Preferably, the upholstery layer comprises a three-dimensional reticulated material (such as for example ZenXit® of Gabriel, Aalborg Denmark; AirSkin® spacer fabric of Springs Creative Products Group, Rock Hill, S.C., USA; Labyrinth® of Enkev, Volendam, The Netherlands; Arnitel® of DSM, Heerlen, The Netherlands; Enkair® of Low&Bonar, Arnhem, The Netherlands) or (such or other) comfort layers as available from Müller Textiles, Wiehl, Germany or TWE Meulebeke BVBA, Meulebeke, Belgium) which may be connected directly to the first layer with the adhesive. It was found that a reticulated layer has an advantage over a foam layer as basic part of a comfort layer since in a reticulated layer air can move freely through the layer which increases the breathability of the mattress.

In another embodiment the adhesive has a first-order transition temperature between 100° C. and 160° C. Preferably the adhesive has a first-order transition temperature between 120° C. and 150° C.

In yet another embodiment the adhesive comprises at least 50% by weight of a polymer chosen from the group consisting of polyurethane, polycarbonate, polyester, mixtures thereof and/or copolymers thereof. Preferably the adhesive comprises at least 50% by weight of a polyester.

In again another embodiment, wherein the assembly of multiple separate parts comprises two or more parts that are made of a polymer, each of the said two or more parts are made of polyester polymer. In other words, all parts that are made of polymer material in the said matrass are made of polyester polymer (not excluding that different parts are made of different kinds of polyester, e.g. different kinds of PET or even a combination of PET and PBT). This embodiment is in particular advantageous since it is easier to assemble and recycle a one-polymer-type mattress given the fact that the pockets as well as the other materials such as the overlaying upholstery material can be manufactured from polyester. So, apart from removing the optional metal springs, no disassembly is needed for complete recycling of the mattress. This method will in particular be useful for mattresses which are manufactured by using polymer pockets and polymer overlaying upholstery. Indeed, when adding other polymer parts to manufacture the mattress such as for example the ticking, or additional foam elements, these are advantageously also made of polyester polymer in this embodiment.

The invention will now be further explained using the following examples.

EXAMPLES

Example 1 provides various adhesives for use in the present invention.

Example 2 describes a method to manufacture a mattress for use in the present invention.

Example 3 describes the monitoring the quality of a mattress during its lifetime, including replacing a worn part.

EXAMPLE 1

In this example various adhesives that are useful in the present invention are described, viz. adhesives that have a first order phase-transition temperature between 80° C. and 180° C., at which temperature the adhesive undergoes a solid-liquid transition. In FIG. 1 a differential scanning calorimetry (DSC) curve of a first adhesive is provided. This adhesive is a polyester made by reacting a mixture of 10 moles terephthalic acid with 8.7 moles 1,6-hexanediol and 1.5 moles ethylene glycol, an elevated temperature (above 220° C.) under the removal of water until adequate conversion.

The DSC measurement was done by following the following path at a speed of 5° C. per minute as follows:

1. Start at −50° C.
2. Increase to 250° C.
3. Cool down to 25° C.

What is shown in the curve of FIG. 1 is the following. The heating from −50° C. to 250° C. (lower line) shows the glass transition ($2^{nd}$ order transition) around 40° C. Also, around 110° C. the solid adhesive starts to melt. Above 140° C. the adhesive is completely molten and transformed into a liquid. The upper line shows the cooling of the adhesive from 250° C. to 25° C. Between 110° C. and 60° C. the crystallization of the molten adhesive is seen with the crystallization point around 80° C. The melting temperature (peak temperature) of this adhesive is 130.7° C. The DSC curve shows that this adhesive undergoes a first order transition at 130.7° C., at which temperature the adhesive undergoes a solid-liquid transition.

Here below in Table 1, several useful adhesives are mentioned (by providing the constituting monomers in the correct mole ratio), together with the temperature at which these adhesives undergo a first order solid-liquid transition.

TABLE 1

Adhesives and their melting temperature

| Adhesive | Tm [° C.] |
|---|---|
| 6.04 mole Terephthalic acid/3.96 mole Fumaric acid/ 10.7 mole 1,6-Hexanediol | 91° C. |
| 7.5 mole Terephthalic acid/2.5 mole Adipic acid/ 10.7 mole 1,6-Hexanediol | 108° C./118° C. |
| 10.0 mole Terephthalic acid/9.31 mole 1,6-Hexanediol/1.49 mole Ethyleneglycol | 121° C./133° C. |
| 10.0 mole Terephthalic acid/4.0 mole Diethyleneglycol/4.0 mole Ethyleneglycol | 171.6° C. |
| 10.0 mole Terephthalic acid/8.7 mole 1,6-Hexanediol/1.5 mole Ethyleneglycol | 130.7° C. |
| 7.5 mole Terephthalic acid/2.5 mole Adipic acid/ 8.7 mole 1,6-Hexanediol/2.8 mole Ethyleneglycol | 91.6° C. |

EXAMPLE 2

This example describes in general the constitution and manufacturing of a common type of mattress, the so called pocket spring mattress. What most pocket coil mattresses have in common is that the coil spring, contained in an individual fabric pocket, lies under a sheet or multiple sheets (i.a. a layer), of padding and cushioning material that provide initial loading softness, a softer sleeper feel, help in reducing localized high pressure interface points, reduce the sensation of lying directly on a metal spring, and help conform to body contours.

Figure 2:
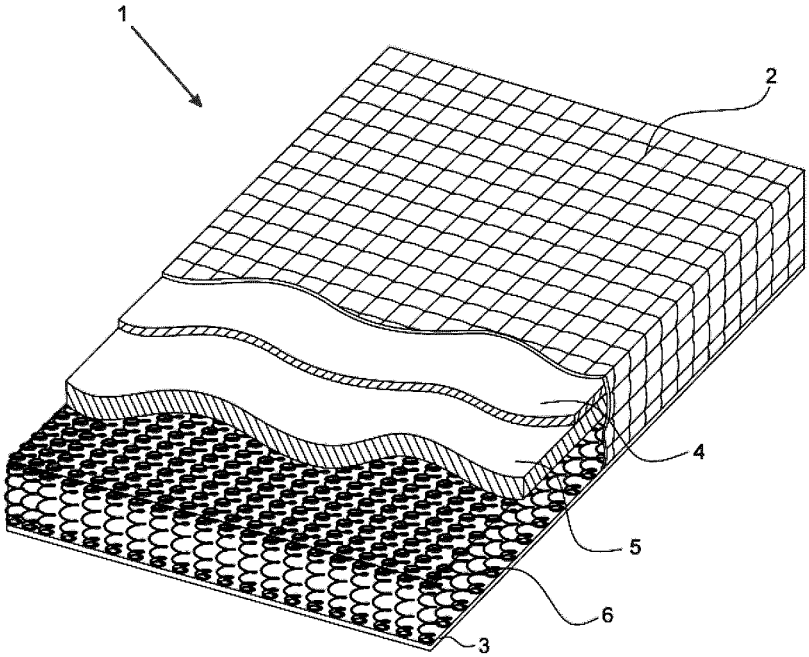
FIG. 2 is a view on a partly cross-sectioned mattress.
Figure 3:
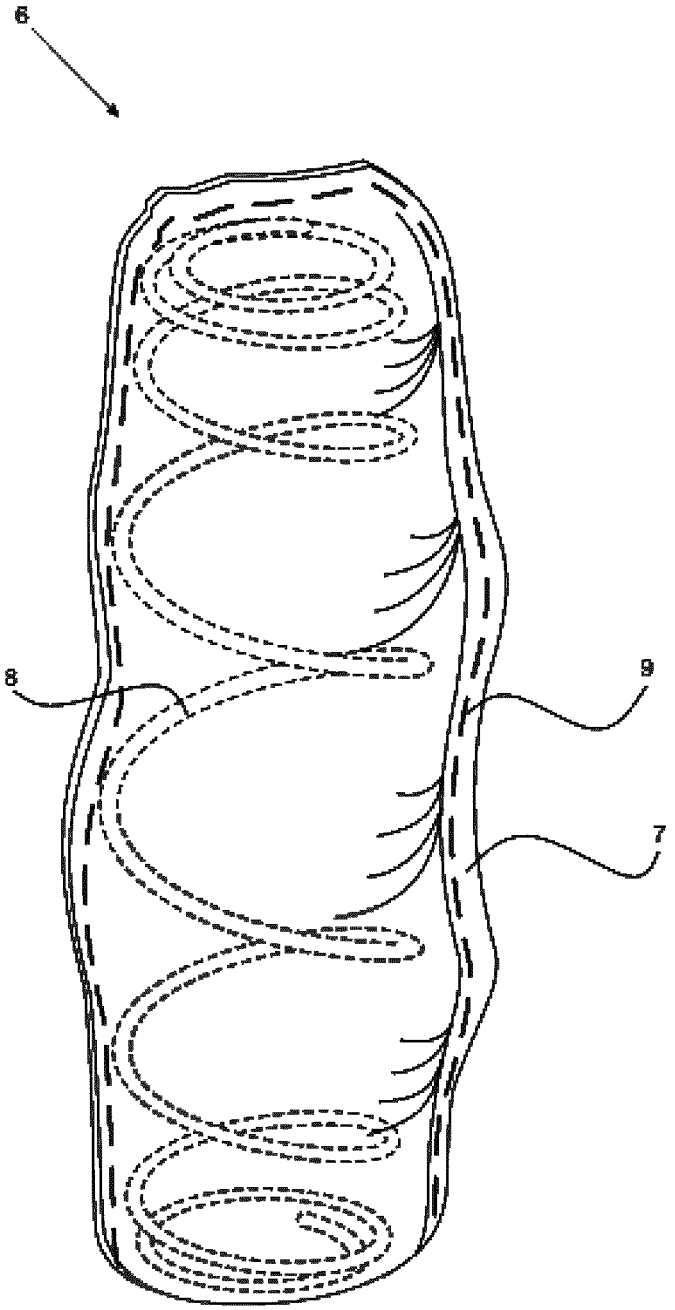
FIG. 3 is a cross section of a pocketed spring.

Referring now to FIGS. 2 and 3, a pocket spring mattress 1 generally has a layer of pocket coil springs 6 (the encasing textile pockets for each spring have not been depicted in FIG. 2), alternatively know as Marshall Type Springs, engaged with a base 3. Mattress 1 further has an upholstery layer comprising a basic padding layer 4 and an upper cushioning layer 5 disposed above pocket coil springs 6. The mattress is enclosed by a mattress ticking cover 2. First described in U.S. Pat. No. 685,160, a Marshall Type Spring is a coil spring 8 encased in a material pocket 7, closed by stitches 9. The pocket coil assemblies are made by inserting coil springs 8 into respective fabric coil pockets 7 that are usually connected in the form of a continuous pocket coil strip. These strips are often made at a specialized production facility and thereafter cut into length and assembled in a 2-dimensional structure to form the support layer of the mattress as depicted in FIG. 2. Layers 4 and 5 are connected to this support layer. To manufacture a mattress that is suitable for use in the present invention, the individual pockets are mechanically connected to each other by using an adhesive that has a first order phase-transition temperature between 80° C. and 180° C., at which temperature the adhesive undergoes a solid-liquid transition. By heating the adhesive to above its phase transition temperature, it can be easily applied to the individual pockets, for example by using a method as known from WO 02/44076 (assigned to Calino S.A). After cooling down to below its crystallisation temperature, the adhesive provides for a strong interconnection of the pockets. Using the same adhesive, or another adhesive (as long as it has a first order phase-transition temperature between 80° C. and 180° C., at which temperature the adhesive undergoes a solid-liquid transition), the layers 4 and 5 can also be connected into the assembly.

EXAMPLE 3

Figure 3A:
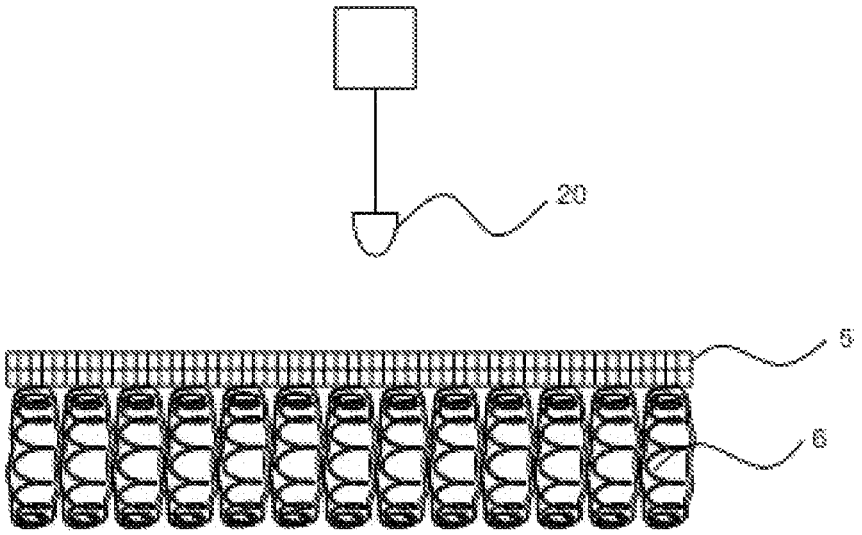
FIG. 3A is a schematic view of a monitoring system that may be used to monitor the quality of a mattress.

This example describes the monitoring of a quality of a mattress (for example the mattress of example 2) during its lifetime, including replacing a worn part. The mattress can be monitored for various properties such as local elasticity of the springs, local elasticity of the upholstery layer, integrity of the various parts, local (lasting) deformation, contamination etc. One or more of these properties is monitored. This can be done by human inspection, or by using a dedicated monitoring apparatus. In case of human inspection for example, the mattress can be inspected for integrity of the comfort layer by applying friction over the ticking to search for irregularities. Elasticity of the springs can also be monitored by hand, by simply pressing and releasing each spring, but it can also be checked automatically in a dedicated testing device such as shown in FIG. 3A whereby an upper cushioning layer 5 is placed over the pocket coil springs 6 and a property such as a local elasticity may be checked using a testing device 20. When it is determined that the property which is monitored for does not meet a predetermined specification (for example: "upholstery layer may not be torn or locally deformed", or "each spring must have at least 95% of its original spring stiffness"), the part in the mattress assembly that correspond to that property is identified. In case of not meeting the "upholstery layer may not be torn", this is the upholstery layer and in case of not meeting the "each spring must have at least 95% of its original spring stiffness" for an individual spring, this is the spring.

The method of the invention now enables relatively easy removal of the part that provides the lack of meeting the predetermined property. Of course, the ticking layer 2 needs to be removed in any case. If the upholstery layer was identified as the "out of spec" part, the adhesive between the upholstery layer and the pocket springs needs to be heated to above its first order transition temperature (its melting point). This can be done for example by using microwaves, heat radiation, light radiation or other form of heating that is able to locally heat a layer in a mattress assembly. As soon as the adhesive is heated and turned into a liquid, the upholstery layer can be easily removed since it is no longer mechanically interconnected with the other parts in the assembly. After that the upholstery layer can be replaced with a new layer. Also, if upon inspection it appears that many sprigs are for example broken, it can also be decided to de-connect all of the pocket springs to completely dismantle the mattress for complete recycling.

The invention claimed is:

1. A method of monitoring quality of a mattress during a lifetime of the mattress, the method comprising:

(a) providing a mattress comprised of an assembly of multiple separate parts which are mechanically interconnected with an adhesive having a first order phase-transition temperature at which the adhesive undergoes solid-liquid transition of between 80° C. and 180° C., (b) assessing during the lifetime of the mattress at least one property of the mattress, (c) determining whether or not the property assessed according to step (b) meets a predetermined specification, and when the property does not meet the predetermined specification, identifying a part of the multiple separate parts that corresponds to the property as a defective part to be removed from the mattress, (d) heating the adhesive interconnecting the identified defective part with any other parts of the assembly above the first order phase-transition thereof so as to disconnect the identified defective part from any other parts of the assembly, and thereafter (e) removing the disconnected identified defective part from the assembly by grasping and pulling the disconnected identified defective part out of the assembly.

2. The method according to claim 1, wherein the assembly comprises a first layer having length and width dimensions that correspond to length and width dimensions of the mattress, and wherein the first layer is a support layer comprising a collection of contiguous pocketed springs, wherein each pair of two contiguous pocketed springs are mechanically interconnected by the adhesive.

3. The method according to claim 1, wherein the assembly comprises two stacked layers having length and width dimensions that correspond to length and width dimensions of the mattress, and wherein the two stacked layers have a different composition and different rigidity, and wherein the two stacked layers are mechanically interconnected by an intermediate layer of the adhesive.

4. The method according to claim 3, wherein a second layer of the two stacked layers is an upholstery layer.

5. The method according to claim 4, wherein the upholstery layer comprises a three-dimensional reticulated material.

6. The method according to claim 5, wherein the reticulated material is connected directly to the first layer with the adhesive.

7. The method according to claim 1, wherein the adhesive has a first-order transition temperature between 100° C. and 160° C.

8. The method according to claim 1, wherein the adhesive has a first-order transition temperature between 130° C. and 150° C.

9. The method according to claim 1, wherein the adhesive comprises at least 50% by weight of a polymer selected from the group consisting of polyurethane, polycarbonate, polyester, mixtures thereof and copolymers thereof.

10. The method according to claim 1, wherein the adhesive comprises at least 50% by weight of a polyester.

11. The method according to claim 1, wherein the assembly of multiple separate parts comprises two or more parts that are made of a polyester polymer.

12. The method according to claim 1, wherein step (a) comprises:

(a1) providing a first layer of contiguous pocketed springs, wherein pockets of the pocketed springs are interconnected by adhering the pockets together with the adhesive having the first order phase-transition temperature between 80° C. and 180° C., and (a2) connecting an overlaying upholstery layer to the first layer by adhering the upholstery layer to the first layer with the adhesive applied in step (a1) or with another adhesive that has a first order phase-transition temperature between 80° C. and 180° C. at which temperature the another adhesive undergoes a solid-liquid transition.

13. The method according to claim 12, wherein the upholstery layer comprises a three-dimensional reticulated material.

14. The method according to claim 12, wherein the adhesive has a first-order transition temperature between 100° C. and 160° C.

15. The method according to claim 12, wherein the adhesive comprises at least 50% by weight of a polymer selected from the group consisting of polyurethane, polycarbonate, polyester, mixtures thereof and copolymers thereof.

16. The method according to claim 12, wherein the adhesive comprises at least 50% by weight of a polyester.

17. The method according to claim 12, wherein the pockets, the overlaying upholstery layer and the adhesive are made of a polyester polymer.

18. A mattress obtained by the method according to claim 12.

19. The method according to claim 12, wherein the adhesive has a first-order transition temperature between 120° C. and 150° C.

20. The method according to claim 1, further comprising the step of:

(f) replacing the removed defective part with a replacement part.

* * * * *